United States Patent [19]

Farrar

[11] Patent Number: 4,967,503

[45] Date of Patent: Nov. 6, 1990

[54] FUNCTION PROTECTING GRIP

[76] Inventor: Frank W. Farrar, 12150 Bloomfield Ave., Santa Fe Springs, Calif. 90670

[21] Appl. No.: 367,844

[22] Filed: Jun. 19, 1989

[51] Int. Cl.[5] ..... F41C 23/10

[52] U.S. Cl. ..... 42/71.02; 42/74

[58] Field of Search ..... 42/71.02, 74

[56] References Cited

U.S. PATENT DOCUMENTS

| | | |
|---|---|---|
| 2,308,627 | 1/1943 | Rickenbacher . |
| 3,672,084 | 6/1972 | Pachmayr . |
| 3,815,270 | 6/1974 | Pachmayr . |
| 4,043,066 | 8/1977 | Pachmayr et al. . |
| 4,586,282 | 5/1986 | Sniezak . |
| 4,638,582 | 1/1987 | Farrar . |

*Primary Examiner*—Stephen C. Bentley

*Assistant Examiner*—Richard W. Wendtland

*Attorney, Agent, or Firm*—Beehler & Pavitt

[57] ABSTRACT

Automatic hand guns in contrast to conventional pistols are commonly supplied with reversing hammer mechanisms for the firing pins immediately above and adjacent to the top of the grip which is set in motion by pulling the trigger. A magazine for shells is held in place in the handle by use of a releasable catch which must be readily manipulated by hand when a magazine is to be removed and replaced. Cushion-type reinforced replaceable grips have portions of the reinforcement specially formed at critical locations to make certain that there is no deformation of those portions of the grip which might otherwise impair either the hammer mechanism or the magazine release.

6 Claims, 3 Drawing Sheets

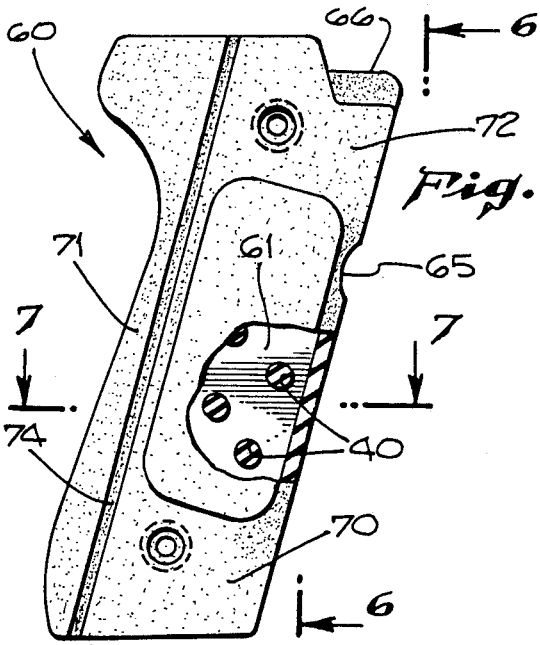
Fig. 5.
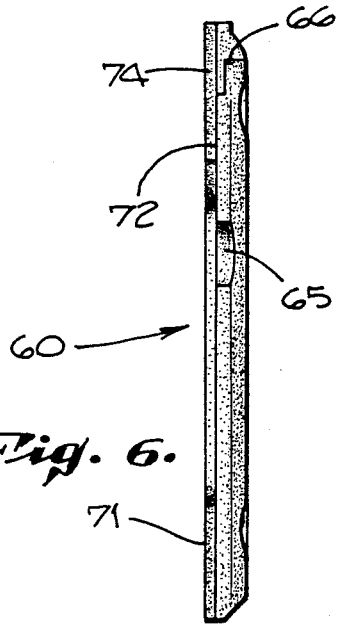
Fig. 6.
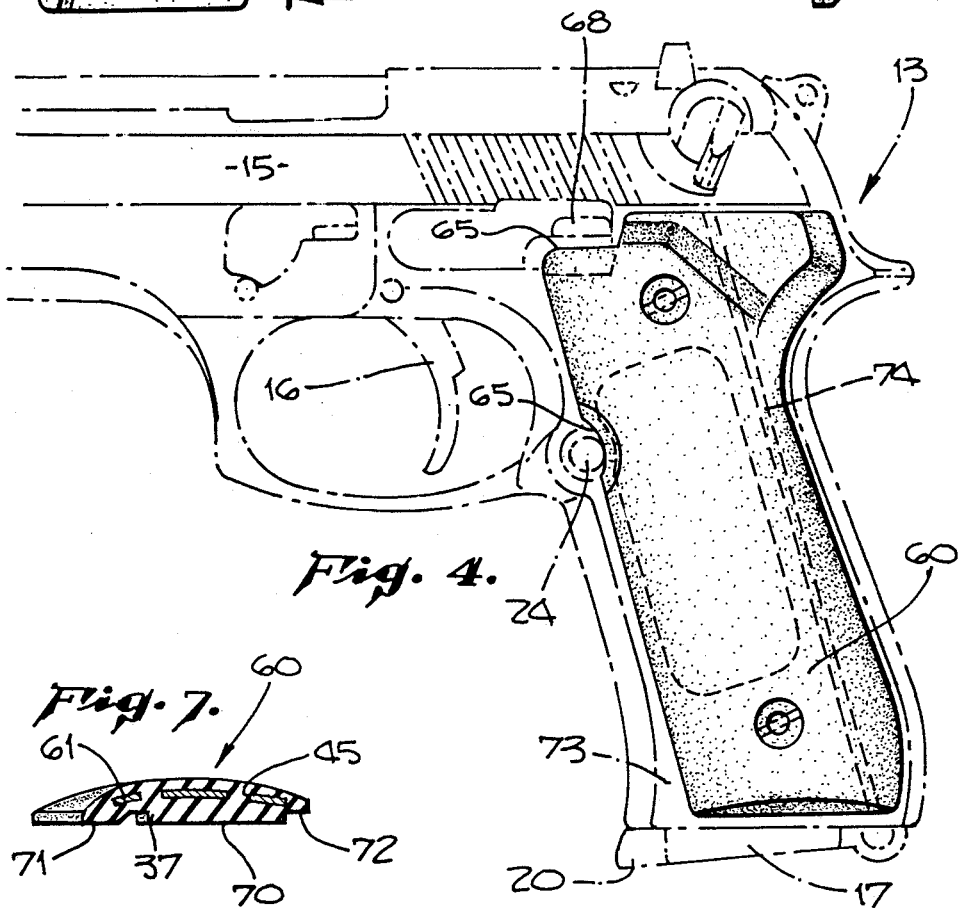
Fig. 4.
Fig. 7.

FUNCTION PROTECTING GRIP

The invention here under consideration is one involving a function protecting grip for a gun, particularly a hand gun or pistol, and is an accessory to comparable grips disclosed in application Ser. No. 194,483, filed May 16, 1988, and U.S. Pat. No. 4,638,582.

It has commonly been the practice for manufacturers of pistols and hand guns to equip them with shaped grips of hard material in the form of matching side panels, one applied to each appropriate face of the handle, with customarily one or more screws to hold the side panels in place.

The fact that a great many users and owners of hand guns find such hard two-piece grips undesirable has prompted those owners and users to seek replacement grips of various kinds which can be fitted to the conventional handle frame.

Because of the weight of guns and pistols of the character described and the recoil effect on the hand of the user, the more acceptable replacement grips have been those of elastomeric material. To enjoy the advantages of such elastomeric grip material, special features have been resorted to. One of these has been to provide a special shape for the exterior of the side panels in order to have them neatly fit into the hand of the user. Another has been resort to a one-piece structure capable of fitting neatly around the metal handle frame. Still another has been to provide such a grip with a form-fitting expedient so that once attached, it remains firmly in place.

More recently there has been appreciable use of semi-automatic hand guns which employ critical operating mechanisms for firing the weapon and also removing spent magazines and reloading the weapon with a replenished magazine. When replacement grips are to be applied to weapons of such character, care must be taken to be sure that the replacement grip will in no way interfere with proper operation of those critical mechanisms.

It is therefore among the objects of the invention to provide a new and improved cushion type grip for the handle frame of a gun which can be readily applied to the handle frame once the original side panels have been removed.

Another object of the invention is to provide a new and improved grip which is relatively easy to attach to the handle frame and also one which is readily removable for replacement, should that become desirable.

Still another object of the invention is to provide a new and improved accurately fitting handle grip of a cushion-like consistency which fits neatly in the hand of the user when in actual use.

Still another object of the invention is to provide a new and improved cushion-like grip for a gun handle of such form and design that it flows neatly into the form and pattern of the gun itself.

Also included among the objects of the invention is to provide a new and improved reinforced grip for the handle frame of a hand gun wherein the reinforcement is specially designed to assure that critical actuating mechanisms are in no way hampered by the special replacement grips when they have been anchored in position on the handle frame.

A further object of the invention is to provide a grip for both sides of a handle frame of a pistol or hand gun specially reinforced so that actuating mechanisms are in no way obstructed while at the same time providing a cushion grip covering all portions of the frame which need to be firmly grasped when the gun is fired.

With these and other objects in view, the invention consists of the construction, arrangements, and combination of the various parts of the device serving as an example only of one or more embodiments of the invention, whereby the objects contemplated are attained, as hereinafter disclosed in the specification and drawings, and pointed out in the appended claims.

In the drawings:

FIG. 4 is a side elevational view on the line 4—4 of FIG. 2.

FIG. 5 is a vertical fragmentary sectional view on the line 5—5 of FIG. 2.

FIG. 6 is a vertical edge elevational view on the line 6—6 of FIG. 5.

FIG. 7 is a cross-secitonal view of the grip taken on the line 7—7 of FIG. 5.

Figure 1:
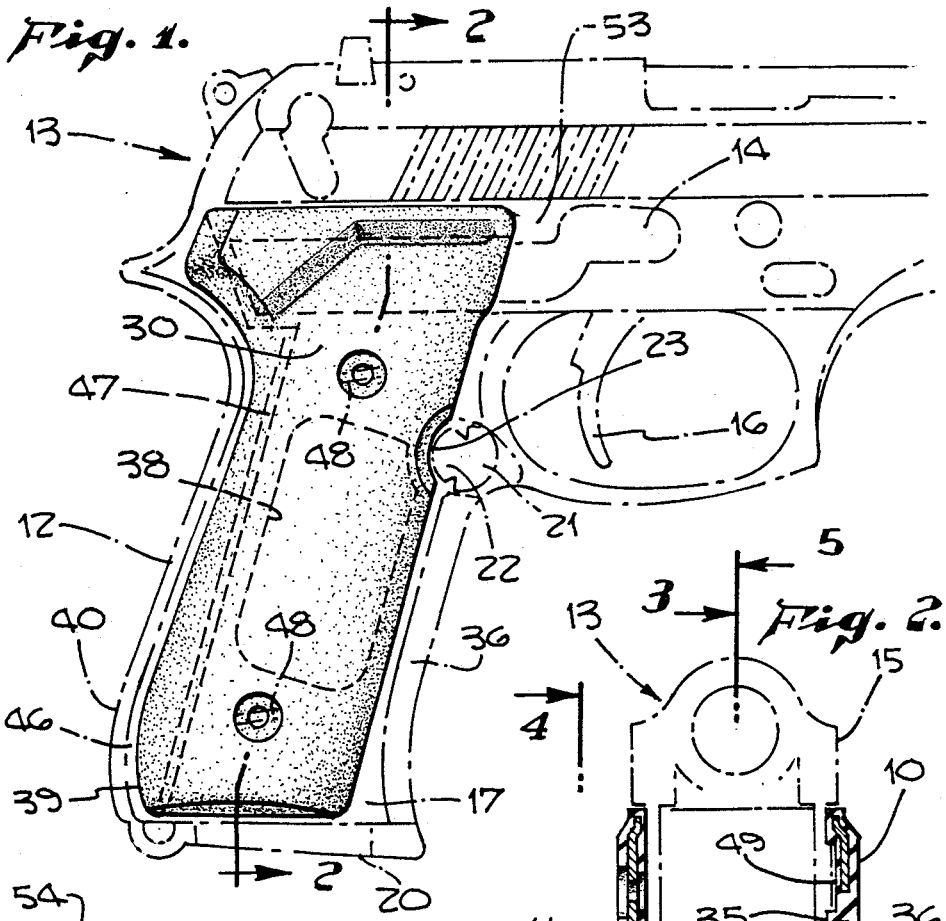
FIG. 1 is a side elevational phantom view of a typical semi-automatic hand gun with the yieldably reinforced gun grip of the invention applied to the handle frame.
Figure 2:
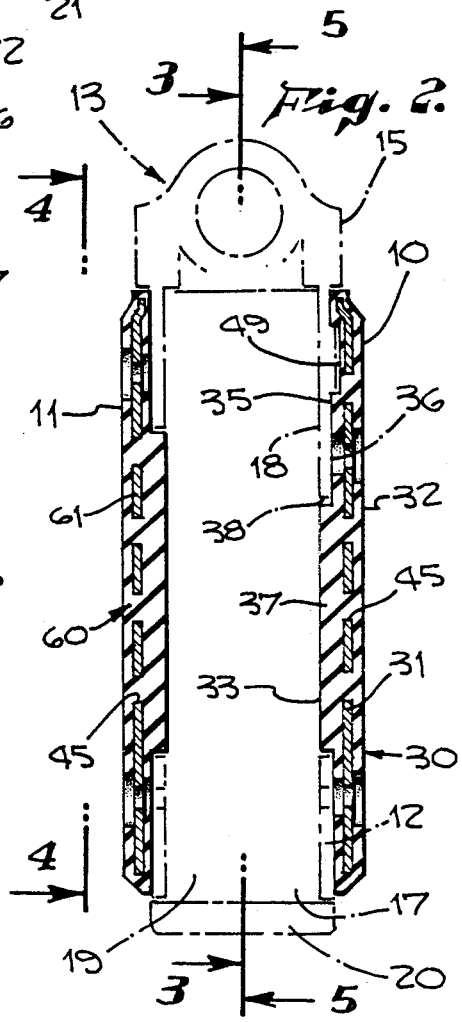
FIG. 2 is a vertical sectional phantom view of the handle frame with the gun grip applied taken on the line 2—2 of FIG. 1.

In an embodiment of the invention chosen for the purpose of illustration the grip is shown in a form making use of right and left side assemblies 10 and 11 respectively applied to corresponding sides of a handle frame 12 of a conventional semi-automatic hand gun 13. In keeping with the design of automatic hand guns of this character, there is a fore and aft automatic reciprocating trigger bar 14 outside a fore and aft frame 25 which supports a barrel at the location. The trigger bar, as part of a trigger mechanism, moves back and forth each time the gun is fired by use of a trigger 16. One reciprocating action takes place every time the gun is fired. This action occurs for each one of the number of shells contained in a magazine 17.

The magazine 17, loaded in the customary way, is contained within a chamber 18 of the handle frame 12 where it is slid into position through an opening 19 at the butt end 20 of the handle frame 12. When the magazine is in the chamber 18, it is held securely in place by a magazine release assembly comprising in part a catch 21. The catch normally has a transverse movement from left to right and right to left for release and engagement with the magazine. Actuated by spring pressure, the catch moves right to left so that an inside finger (not shown) can engage the magazine and hold it in the chamber 18 within the handle frame 12 when the gun is being fired. An exterior raised portion 22 of the catch 21 resides in a recess 23 at the side of the magazine and needs to clear the grip when moved to release position. After all the shells are expended, a magazine release button 24 on the opposite or left side of the handle frame 12 magazines so theat it can be replaced with a freshly loaded magazine. is pressed inwards by the operator's finger to release the empty Since the button 24 and raised portion 22 are part of the same magazine release assembly as the catch 21, the finger (not shown) is lifted clear of the magazine to release it. For the gun to be operated successfully, all parts of the magazine release assembly must be clear of the grip and free for movement at all times.

In the preferred form of the invention the grip consists of the initially identified right side assembly 10 and the left side assembly 11 which have comparable characteristics. The right side assembly, taken by way of example, consists of a relatively flat panel 30 of semiyieldable elastomeric material in which is embedded a reinforcing plate 31.

The panel 30 has a broad exposed face 32 which may be molded into a form fitting comfortably into the hand of the user. An opposite normally concealed face 33 has flat areas 34 and 35 facing and mounted in engagement with a complementary side face 36 of the handle frame 12. A rectangular protrusion 37 is lodged in a complementary rectangular opening 38 of the handle frame 12. The panel, moreover, has a perimetrical edge 39 which follows approximately the perimetrical edge 40 of the handle frame 12.

Embedded in the panel 30 is the reinforcing plate 31. Embedding is accomplished by molding in place. For more effective retention there is an array of perforations 45 in the reinforcing plate into which some of the elastomeric material of the panel finds its way to make the combination more retentive. That portion of the panel identified by the flat area 34 is to a degree thicker than the remainder so that it protrudes into a corresponding depressed portion 46 of the handle frame. A resulting ridge 47 serves to securely orient the panel on the handle frame when it is attached by use of conventional screws 48.

Figure 3:
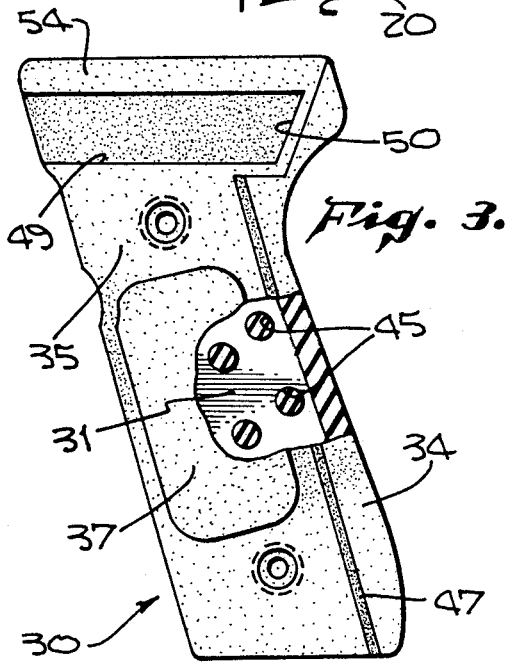
FIG. 3 is a vertical fragmentary sectional view on the line 3—3 of FIG. 2.
Figure 8:
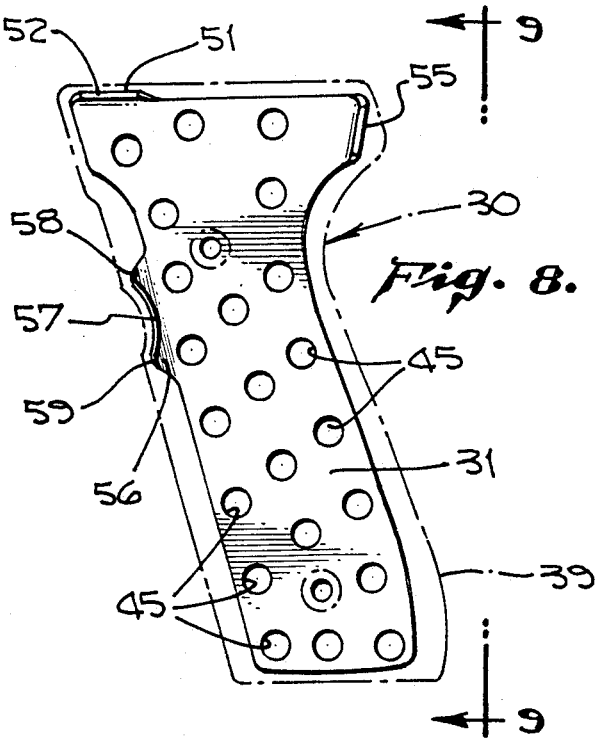
FIG. 8 is a vertical plan view of the reinforcement plate for the grip on one side of the frame with the mass of elastomeric material in phantom.
Figure 9:
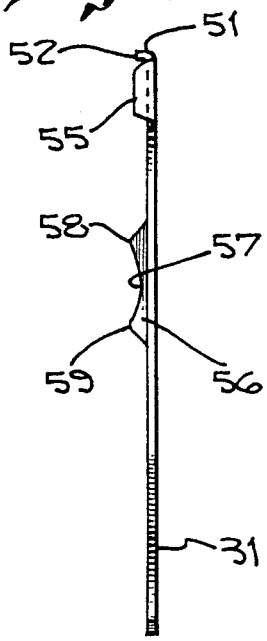
FIG. 9 is an edge elevational view of the reinforcement plate on the line 9—9 of FIG. 8.

To make provision for freedom of movement of the trigger bar 14, a slot 49 is provided on the concealed face 33 of the panel 30 having a bottom end 50 (see FIG. 3). To make certain that all portions of the elastomeric material of the panel stay clear of the trigger mechanism, there is a tab 51 at the upper end of the reinforcing plate 31. The tab in the preferred embodiment is a portion of the reinforcing plate material bent in the direction of the slot so that an edge 52 bears against that area 53 of the handle frame above the location of the trigger bar (see FIG. 1). The tab with its edge 52 concealed by the panel material when in use resides in an upper part 54 of the area 35 which overlies the slot 49. A second tab 55 (see FIG. 8), also consisting of a bent portion of the reinforcing plate, is located in the panel material at the base of the slot. The tabs 51 and 55 in cooperation with each other assure that the slot remains open and clear.

As the hand gun comes from the manufacturer, the trigger bar 14 is of such design and structure that it can be pulled laterally outward to disengage it from the trigger 16. A factory supplied hand grip panel (not shown) is of a fixed rigid character and prevents such disengagement. When the original hand grip panel is replaced with the yieldable elastomeric panel 30, the needed rigidity is provided by use of the reinforcing plate 31 with its tabs 51, 55 and abutment tabs 58, 59. When the screws 48 are driven into place, a preloaded spring pressure is applied against the tabs whereby they hold their form and position sufficient to prevent the trigger bar from being accidentally pried out of engagement with the trigger 16 as well as to keep it clear for fore and aft movement.

Since it is important in the handling of the hand gun to unload and reload the magazine, the catch 21 must be certain of operation at all times. The recess 23 provides clearance for the user's fingers. Additionally, to avoid prospect of grip material extending over the catch, a bridge tab 56 has been provided. As with the other tabs, the bridge tab is likewise a portion of the reinforcing plate 31 bent in a direction toward the adjacent face of the handle frame 12. On this occasion an arcuate mid-portion 57 spans the raised portion 22 of the catch 21. By having end abutment tabs 58 and 59 in positions to bear against the face of the handle frame at a location clear of the raised portion, support is provided for the material of the panel so that the space within the arcuate mid-portion 57 is kept clear.

Incidentally, in its original factory condition the magazine release assembly consisting as it does of the catch 21, raised portion 22 and button 24 can be disassembled from the gun. This is accomplished by removing the magazine 17 and also the original grip panel on the release button side and then applying finger pressure to the opposite side. Thereafter the entire magazine release assembly will fall out of the hand gun.

A similar structure is made use of for a left side panel 60 and its reinforcing plate 61. On the left side is the button 24 of the magazine release assembly, previously described. To accommodate the button there is a bridge with tabs 63, 63' and the arcuate mid-portion 64 to prevent material of the panel 60 extending into a recess 65 at the location of the button. The recess 65 follows the form of the arcuate mid-portion 64 to provide the necessary clearance.

Should the hand gun be equipped with non-reinforced elastomeric grip panels, the same disassembly could occur with only the magazine removed, because the panel material would yield allowing the magazine release assembly to fall out unintentionally.

Further in its original factory condition the hand gun is so constructed that the magazine release assembly can be reversed from one side to the other. Reversal is provided for so that release of the magazine can be made easy for either a right-handed or a left-handed operator. Accordingly, by providing tabs 58, 59 on the panel 30 and tabs 63, 63' on the panel 60 at the same relative location, the panels 30 and 60 will accommodate either a right-handed or left-handed adjustment of the magazine release assembly.

Figure 10:
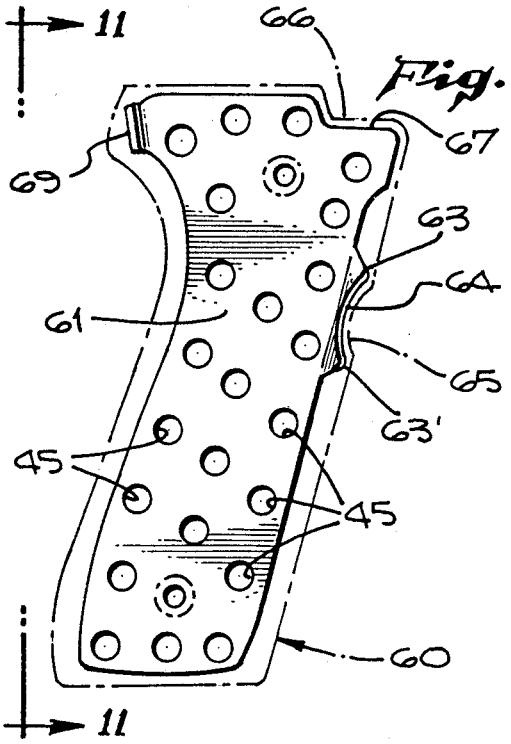
FIG. 10 is a vertical plan view of the reinforcement plate for the grip on the other side of the frame with the elastomeric material in phantom.
Figure 11:
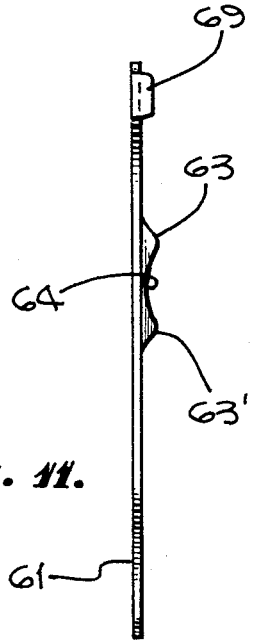
FIG. 11 is an edge elevational view of the reinforcement plate on the line 11—11 of FIG. 10.

Additionally on the upper left side of the left panel 60 (see FIG. 4) is a notch 66 to provide a clearance for a latch 68 of the gun mechanism. There is a similar notch 67 in the reinforcing plate (see FIG. 10). At the opposite upper end is a tab 69 bent from the material of the reinforcing plate 61 in the same manner as previously described to maintain the form of the left side panel 60 at the top rear corner.

On the concealed face 70 of the left side panel 60 are flat areas 71 and 72 at different levels for engagement with a complementary side face 73 of the handle frame 12. Being at different levels the flat areas provide a ridge 74 of the same character and purpose as the previously described ridge 47.

While a particular embodiment of the present invention has been shown and described, it will be obvious to those skilled in the art that changes and modifications may be made without departing from the invention in its broader aspects and, therefore, the aims of its appended claims are to cover all such changes and modifications as fall within the true spirit and scope of this invention.

Having described the invention, what is claimed as new in support of Letters Patent is as follows:

1. A yieldably reinforced grip for the handle frame of a hand gun wherein operating mechanism of the hand gun is at a location adjacent the reinforced grip, said grip comprising a side panel of elastomeric material having a perimetrical edge in general conformance with an adjacent perimetrical edge of the frame, an outside face of the grip having a molded configuration, a substantially rigid reinforcing plate having a planer surface condition adapted in cooperation with the frame to hold said side panel in engagement with an adjacent side of the frame, said reinforcing plate being of semi-yieldable composition and embedded in the elastomeric material of said grip, there being an edge portion of said reinforcing plate at locations adjacent said operating mechanism of the hand gun, said edge portion being in a position extending transversely of the plane of the reinforcing plate into engagement with the frame, at least one edge portion of the reinforcing plate including a bridge tab having a recessed mid-portion and abutments at opposite ends of the recessed mid-portion for support of said recessed mid-portion.

2. A yieldably reinforced grip as in claim 1 wherein the material of said grip has a recessed configuration at the location of said bridge tab which coincides with the form of said recessed mid-portion.

3. A yieldably reinforced grip as in claim 1 wherein the plane of said bridge tab has an oblique direction relative to the plane of the reinforcing plate and is embedded in a relatively thinner area of the panel.

4. A yieldably reinforced grip as in claim 1 wherein an exposed side face of the handle frame is at different levels with a ridge therebetween and an inside face of the corresponding side panel has a complementary ridge for engagement with the ridge of the frame.

5. A yieldably reinforced grip means in combination with a hand gun wherein the hand gun has a handle frame and a magazine release assembly in the handle frame including a transversely actuating button having optional reversible positions at corresponding locations on opposite side faces of the handle frame, said grip means comprising a panel of elastomeric material for each side face of the handle frame, a substantially rigid reinforcing plate in each said panel at a location intermediate opposite side faces of the panel, and adapted in cooperation with the corresponding panel to hold the grip means in engagement with the corresponding face of the handle frame, there being edge portions of the reinforcing plates forming tabs at similar locations adjacent the magazine release assembly, said tabs being in positions extending transversely of the planes of the corresponding reinforcing plates into engagement with the corresponding face of the handle frame whereby to position edges of the tabs in engagement with the handle frame.

6. A yieldably reinforced grip as in claim 5 wherein an exposed side face of the handle frame is at different levels with a ridge therebetween and an inside face of the corresponding side panel has a complementary ridge for engagement with the ridge of the frame.

* * * * *